US006519992B1

(12) United States Patent
Schnupp

(10) Patent No.: US 6,519,992 B1
(45) Date of Patent: Feb. 18, 2003

(54) METHOD FOR OPERATING A FORMING PRESS

(76) Inventor: Konrad Schnupp, Further Strasse 63, D-94327 Bogen (DE)

( * ) Notice: Subject to any disclaimer, the term of this patent is extended or adjusted under 35 U.S.C. 154(b) by 113 days.

(21) Appl. No.: 09/787,949

(22) PCT Filed: Aug. 9, 2000

(86) PCT No.: PCT/EP00/07753

§ 371 (c)(1),
(2), (4) Date: Mar. 23, 2001

(87) PCT Pub. No.: WO01/14078

PCT Pub. Date: Mar. 1, 2001

(30) Foreign Application Priority Data

Aug. 20, 1999 (DE) ..... 199 39 504

(51) Int. Cl.[7] ..... B21D 26/02
(52) U.S. Cl. ..... 72/57; 72/60; 29/421.1
(58) Field of Search ..... 72/56, 57, 60, 72/62, 407; 29/421.1

(56) References Cited

U.S. PATENT DOCUMENTS 3,222,902 A * 12/1965 Brejcha et al. ..... 29/421.2
3,769,824 A * 11/1973 Granzow ..... 72/60
4,191,045 A * 3/1980 Stepantsov et al. ..... 72/407
4,770,015 A * 9/1988 De Smet ..... 29/421.1
4,833,903 A * 5/1989 de Smet ..... 72/57
5,067,336 A * 11/1991 de Smet ..... 72/57

FOREIGN PATENT DOCUMENTS

DE 43 39 828 A1 5/1995
DE 195 13 444 A1 10/1996

* cited by examiner

*Primary Examiner*—David Jones
(74) *Attorney, Agent, or Firm*—Shinjyu Global IP Counselors, LLP

(57) ABSTRACT

A method of operating a metal forming press in which in a rigid press frame a workpiece is preloaded against a tool by means of a hold-down force, with at least one ram tool applying a ram force in parallel with the hold-down force, and closing cylinder forces being applied opposite to the ram force and the hold-down force, and a water chamber die being formed in the tool, whereby water chamber die forces can act on the workpiece, characterized in that the disturbing force resulting from the application of the ram force is determined and compensated by a change in the closing cylinder forces.

18 Claims, 10 Drawing Sheets

METHOD FOR OPERATING A FORMING PRESS

This application is the national phase under 35 U.S.C. §371 of International Application No. PCT/EP00/07753, which was filed on Aug. 9, 2000 and published in German on Mar. 1, 2001.

FIELD OF THE INVENTION

The present invention relates to a method of operating a metal forming press in which in a rigid press frame a workpiece is preloaded against a tool by means of a hold-down force, with at least one ram tool applying a ram force in parallel with the hold-down force, and closing cylinder forces being applied opposite to the ram force and the hold-down force, and a water chamber die being formed in the tool, whereby water chamber die forces can act on the workpiece.

BACKGROUND OF THE INVENTION

A metal forming press of the above-described type is already known from German patent application 195 13 444.

Said metal forming press is inter alia characterized by the decisive advantage that for both internal high-pressure metal forming and external high-pressure metal forming it is possible to lock both the ram tool and the hold-down devices and to apply the necessary further metal-forming forces by means of a multitude of closing cylinders. Said closing cylinders can be controlled in a selective way and can act on the most different portions of the workpiece owing to their arrangement. Large forces can thus be applied at short piston travels of the cylinders.

However, it has been found out in the operation of the above-described metal forming press that the necessary hold-down forces cannot be realized or can only be realized in an inadequate manner for specific workpieces.

SUMMARY OF THE INVENTION

It is the object of the present invention to provide a method of the above-mentioned type which is simple and can be carried out easily and permits the application of exact hold-down forces and is also applicable to the most different workpieces.

According to the invention this object is achieved by the features of the main claim; the subclaims show further advantageous developments of the invention.

Thus, according to the invention, the disturbing force resulting from the application of the ram force is determined and compensated by a change in the closing cylinder forces.

The method according to the invention is characterized by a number of considerable advantages.

It is possible with the procedure according to the invention to compensate the disturbing force which occurs in the whole system due to the application of the ram force. It has been found that the closing cylinders react at least in part like elastic elements and deform upon application of a ram force and/or a water chamber die force. This deformation, in turn, together with the elasticity of the tool, has the effect that the hold-down forces are changing. These are either higher or lower, depending on the corresponding deformation. As a consequence, the metal forming parameters change, resulting in flaws (excessively strong or weak feed flow of the material of the workpiece).

The above-described problems are avoided by the method of the invention.

In sheet-like workpieces the hold-down force controls the sheet movement and produces a sufficient surface pressure on the tool to seal the water chamber die at the pressures arising. The hold-down force is adapted to the necessary water chamber die pressure, ideally in response to the ram travel, and varies over the whole flange area of the workpiece to compensate for locally different metal forming degrees.

In a metal forming press of the above-described type the pressure prevailing in the water chamber die is initially only a few bar and then rises to a few hundred bar in the finishing shaping process of the workpiece.

According to an advantageous development of the invention, the disturbing force is measured by a change in the hold-down force. It is here possible to use the hold-down cylinders as pressure sensors, so that additional measuring means, such as pressure cells, can be dispensed with. This simplifies the structure of the metal forming press quite considerably. Similarly, in an advantageous development of the invention, the change in the hold-down force can be determined by a change in pressure in the respective hold-down cylinders.

The disturbing force is advantageously compensated by locally different closing cylinder forces. Since in the metal forming press according to the invention the closing cylinders can be arranged in variable order to position the same such that they are adapted to the geometry of the workpiece and the arising forces, it is also possible to act on individual ones of the closing cylinders at different pressures. Thus, according to the invention individual closing cylinders can be acted upon by pressure more strongly than other closing cylinders. The elastic deformation of the tool can be compensated such that the desired hold-down forces are maintained. According to the invention the pressure of individual closing cylinders can thus be changed advantageously in different ways.

For the determination of the necessary parameters and for performing an optimum metal forming process it is particularly advantageous when the sum of the closing cylinder forces is constant for a respective phase of a metal forming process. This means that the sum of the individual closing cylinder forces, i.e. the total closing-cylinder force is distributed over individual control circuits of the individual closing cylinders. The distribution may preferably be in percent, so that a value of 100% is obtained for the total closing-cylinder force. This distribution of the total closing-cylinder force in percent takes into account a hold-down force curve as a reference variable which inter alia depends on the hold-down path and the ram travel and the ram force, respectively. The hold-down force curve is measured via the pressure of the hold-down cylinders, multiplied by the active area. For the individual phases of a metal forming operation deviations from said desired value of the hold-down force or from the predetermined hold-down force curve are then corrected according to a control scheme to be still described. It is thus possible to determine, either empirically or mathematically, both the number of the individual closing cylinders and their control circuits as well as their load carrying capacity in percent. For instance, at the beginning of an optimizing process a uniform load carrying capacity may be assumed. Possible flaws in the tool can thus be compensated or avoided by locally changing the hold-down force. Said local changes in the respective local hold-down forces are effected by changes in the individual closing-cylinder forces. When the individual force of a closing cylinder is increased or decreased, the respective force of the remaining closing cylinders will also change in accordance with the predetermined distribution key in percentage. Such a compensation in percentage is preferably carried out fully automatically within the scope of the present invention.

To achieve an optimum metal-forming result, it may be advantageous that the hold-down force that is respectively optimum in time and location is determined at the beginning and that the change in the closing cylinder forces is varied for maintaining said hold-down force. An optimum curve of the hold-down force at locally very different places can thus be realized by means of the press control.

It is particularly advantageous when for each metal forming process the necessary hold-down forces are divided into individual zone-like areas of the workpiece and determined with respect to their respective value and the individual closing cylinder forces are adapted to the respective areas.

For the determination of the necessary hold-down forces the metal forming operation is preferably divided into individual phases, and the hold-down forces are determined for said phases by means of finite element methods both locally and in time and according to the value. The respective closing cylinder forces can thus be applied to be assigned locally and in time to the hold-down forces.

It is particularly advantageous when the closing cylinder forces are chosen to have a value greater than the closing cylinder forces which are each mathematically predetermined locally and in time.

This yields a closing cylinder force that is increased by a few percent in each of the closing cylinders so as to compensate for possible errors in the mathematical predetermination and for tolerances in the workpiece characteristics. At any rate it is ensured that the water chamber die is sufficiently sealed.

To predetermine the arrangement and position of the individual closing cylinders, it may be particularly advantageous when the resulting total force is determined for the individual metal-forming steps with respect to magnitude and three-dimensional position and when the local assignment of the closing cylinders is carried out in response to the respective position of the resulting total force.

Thus, in the procedure according to the invention the ideal force curve is determined for the partial hold-down forces and the water chamber die pressure in response to the travel of the ram tool by means of finite-element methods and/or by means of computer simulation. The metal forming process is here divided into individual phases and assigned to the respective force curves. The travels (strokes) and the associated force curves determine the functional sequence of the metal forming press. At a great drawing depth and at a small force the metal forming operation can e.g. be carried out via the ram tool only; in the case of flat components with a high force possibly via the closing cylinders only. Normally, i.e. at a great drawing depth and at a great force, the metal forming process is carried out via the ram tool and the closing cylinders.

According to the invention the above-mentioned individual phases can form either time intervals of the forming process or path segments of the ram tool. It is thus possible within the scope of the invention to optimize the forming process in many ways so that it is adapted to the respective requirements. Thus it is e.g. possible to carry out a weighting operation during the stroke of e.g. the ram tool in accordance with predetermined paths (e.g. 1 mm, 1.5 mm, 2 mm, etc.) and to adjust the closing cylinder forces as described above, either in their total magnitude or in their percentage distribution. This applies analogously to the possibility of realizing the individual phases as time intervals. For instance, it is possible that the control unit requests the respective values in steps of milliseconds and performs a corresponding compensating operation.

After the forces (ram force, water chamber die force and partial hold-down forces) have been determined or predetermined over the whole forming process, the forming operation is carried out according to the invention as follows:

1. The closing cylinders are positioned such that the calculated hold-down forces and the closing forces can be introduced in an optimum way. To this end all forces have to be considered throughout the forming process. In the press of the invention it is possible to control individual closing cylinders separately and to switch them on or off, optionally also separately. A switching to a rapid movement is also possible, namely through connection of the annular chamber side to the bottom side. It is thereby ensured that the position of the closing cylinders can be chosen such that the flange movement of the workpiece is locally influenced in an optimum way. The pressure range during the forming process can be chosen such that an optimum result is achieved. It goes without saying that the arising forces can be determined mathematically with respect to their minimum and maximum values to determine both the size and the position of the individual closing cylinders.

After these steps of the process have been completed, the press is closed; the hold-down locks can be retracted. Thus the hold-down cylinders are extended until abutment; the closing cylinders are lowered.

2. For producing the hold-down forces the closing cylinder forces must overcome, apart from the hold-down force, the press and tool parts to be lifted and the resulting forces, the frictional force on the guides and in the cylinders, and the ram force. The latter, in turn, is a function of the water chamber die pressure, multiplied by the actual contact surface between ram tool and sheet metal plate or blank. A further component of the disturbing force is due to an oblique movement of the plate and also has an effect on the water chamber die. The respective hold-down force is directly obtained by sensing the pressures (bottom and annular chamber side) at the hold-down cylinders, multiplied by the active areas. The weights of the hold-down rings and the tool are added to said value. This yields the total hold-down force.

3. A look at the following five phases or steps of the forming process reveals the following relationships for the cooperation of hold-down force and closing cylinder force:

a. close press and lock hold-down device b. build-up hold-down pressure and pre-arching c. move down and lock ram d. move water chamber die and sheet holder upwards by means of closing cylinders, thereby preloading the same against the hold-down cylinders e. form the workpiece f. decompress, unlock and open the metal forming press.

Regarding a: After the metal forming press has been closed, the hold-down locks are retracted, the hold-down cylinders are extended until abutment, the closing cylinders are lowered.

Regarding b: The extended hold-down cylinders are blocked and produce a maximum force; the closing cylinders open and clamp the workpiece firmly between the water chamber die and the hold-down ring, so that no plate movement of the workpiece takes place during the preforming operation and the maximum hold-down force is not reached. Fluid is now fed into the water chamber die and is measured either via the pressure prevailing in the water chamber die or via the amount of the supplied fluid until the desired pre-arching is achieved.

Regarding c: The closing cylinders lower their force such that the respectively desired hold-down pressure is achieved in part without retraction of the hold-down cylinders. The hold-down cylinders are rendered pressureless for a short period of time for subsequent use as a "pressure cell". The closing cylinders then move upwards, thereby developing the closing force assigned to them. The sum of the closing cylinder forces must yield the predetermined total hold-down force. For controlling the disturbing forces, such as ram force, friction and weights, the actual hold-down force is determined in a computer. The latter compares the desired value and the actual value and controls the individual closing cylinder control circuits in percent. It is thus ensured that the partial allocation of the hold-down forces takes place according to the predetermined values in the intended ratio. The hold-down cylinders act as rigid spacers and just assume a measuring function.

Regarding d: After the ram or the ram tool has reached its lower dead center and has been locked, the forming process is continued. The clamped workpiece (plate or blank) is now drawn over the fixed ram tool. The hold-down cylinders must apply the predetermined hold-down force. This is accomplished in that pressures depending on the ram path are predetermined for the hold-down cylinders. The pressure curve is monitored by the control unit. In case of deviations these are assigned to the individual closing cylinder circuits to produce pressure compensation in part by the closing cylinders. This, however, would just produce a force equilibrium, but it would not be possible yet to apply a movement. Therefore, the control unit automatically adds an offset to the predetermined values of the closing cylinder forces, with the offset being always a few percent higher than is achievable forcewise. Forcewise achievability means here the production of the predetermined hold-down force and thus the displacement of the hold-down cylinders that corresponds to a further closing cylinder stroke. This method ensures variable hold-down forces with a partially different predetermined distribution in the flange area of the workpiece during the forming stroke.

Regarding e: After the closing cylinder stroke has been completed, the workpiece is in its formed state; however, for producing radii and sharp-edged contours both the closing pressure of the closing cylinders and the water chamber die pressure are raised to a maximum value. A possibly necessary sheet movement of the workpiece is still possible without the sealing effect being overcome between the workpiece and the water chamber die.

Regarding f: After all of the pressures have been reduced, the closing cylinders are lowered, both the ram tool and the hold-down cylinders are unlocked, and the tool is opened.

Thus according to the invention this enables the operator who designs or programs or operates the metal forming press to take into account many parameters for optimizing the forming process. The most important parameters are listed below:

- hold-down force curve in dependence upon the position of the ram hold-down device,
- curve of the water chamber die pressure in dependence upon the position of the ram hold-down device,
- number and position of the individual closing cylinders and/or
- number and geometry of the closing cylinder circuits and their pressure curves in dependence upon the position of the ram hold-down device.

BRIEF DESCRIPTION OF THE DRAWINGS

The invention shall now be described with reference to an embodiment taken in conjunction with the drawing, in which.

DETAILED DESCRIPTION OF THE INVENTION

Figure 1:
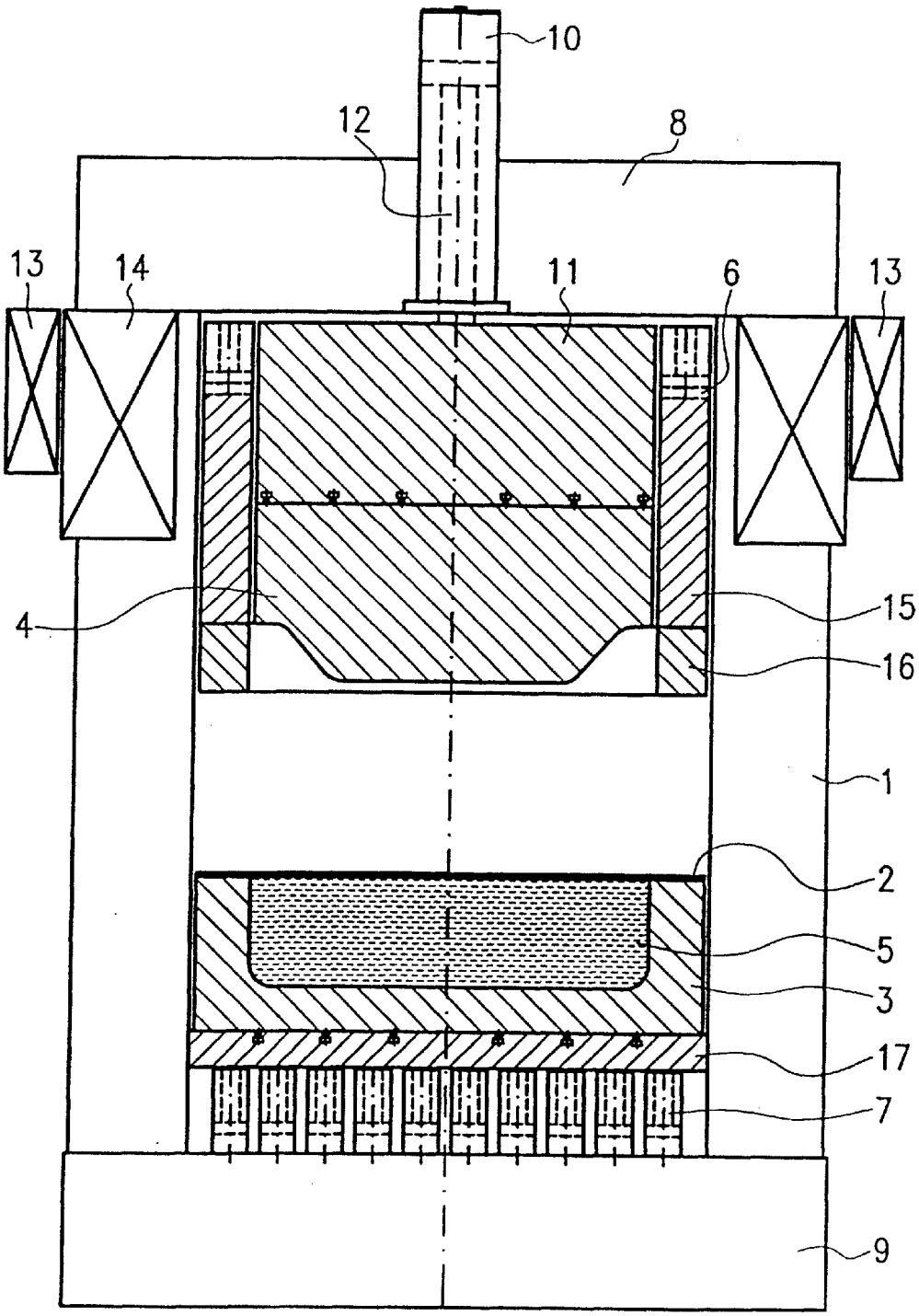
FIG. 1 is a schematic illustration showing the metal forming press of the invention in the opened initial state.

FIGS. 1 to 4 are schematic views showing a metal forming press. The press comprises a closed press frame 1 (see also FIG. 5). The press frame 1 comprises an upper transverse beam 8 and a lower transverse beam 9. The upper beam 8 has arranged thereon a ram or plunger cylinder 10 whose piston rod 12 supports a ram or plunger 11. The ram 11, in turn, has fastened thereto a ram tool 4 which corresponds to the shape of the finished workpiece 2. FIG. 1 shows the workpiece 2 in the form of a planar sheet-metal plate or blank.

Furthermore, the metal forming press is provided in its upper portion with hold-down locks 13 and with ram locks 14. The hold-down locks 13 and the ram locks 14 are each movable in horizontal direction.

The upper portion of the metal forming press has further arranged therein hold-down cylinders 6 which act on a hold-down ring 15 whose front side has arranged thereon a hold-down tool 16.

The lower portion of the press has arranged therein on the lower beam a plurality of closing cylinders 7 which are individually supplied with hydraulic fluid and the position of which can be adapted in accordance with the respective requirements. The closing cylinders 7 act on a table top 17 on which a tool 3 is mounted. The tool comprises a water chamber die or trough 5 which can be acted upon with water.

For the sake of a simplified illustration the individual hydraulic lines and water conduits as well as further control means etc. are not shown in FIGS. 1 to 4.

FIG. 1 shows the metal forming press in its opened state in which a plate- or blank-like workpiece 2 can be inserted.

Figure 2:
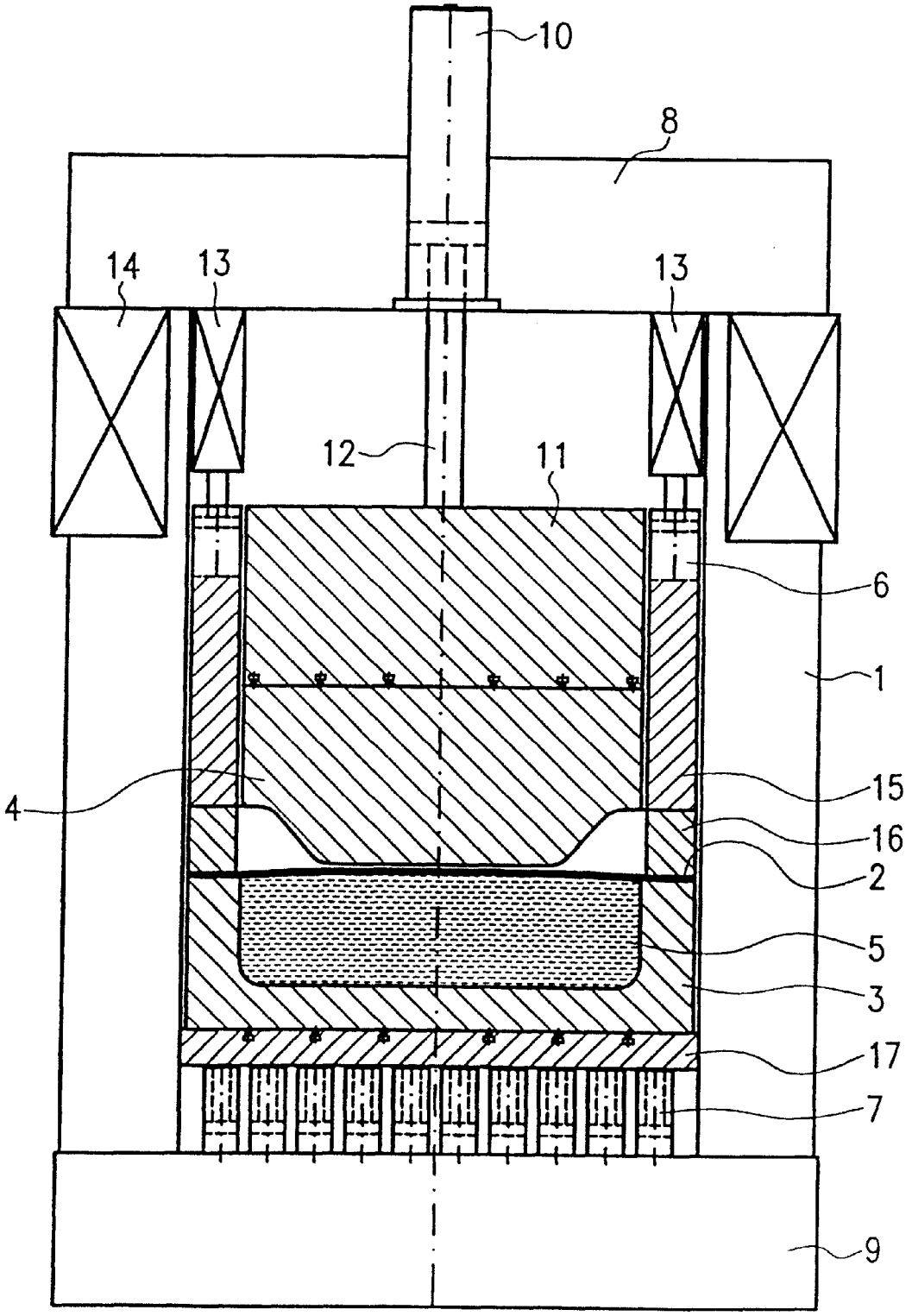
FIG. 2 is a view, analogous to FIG. 1, showing a process step in which the workpiece is pre-arched.

FIG. 2 shows a state in which the ram together with the ram tool has been moved downwards. In this state a small pressure is applied to the water chamber die 5 to pre-arch the workpiece 2.

Figure 3:
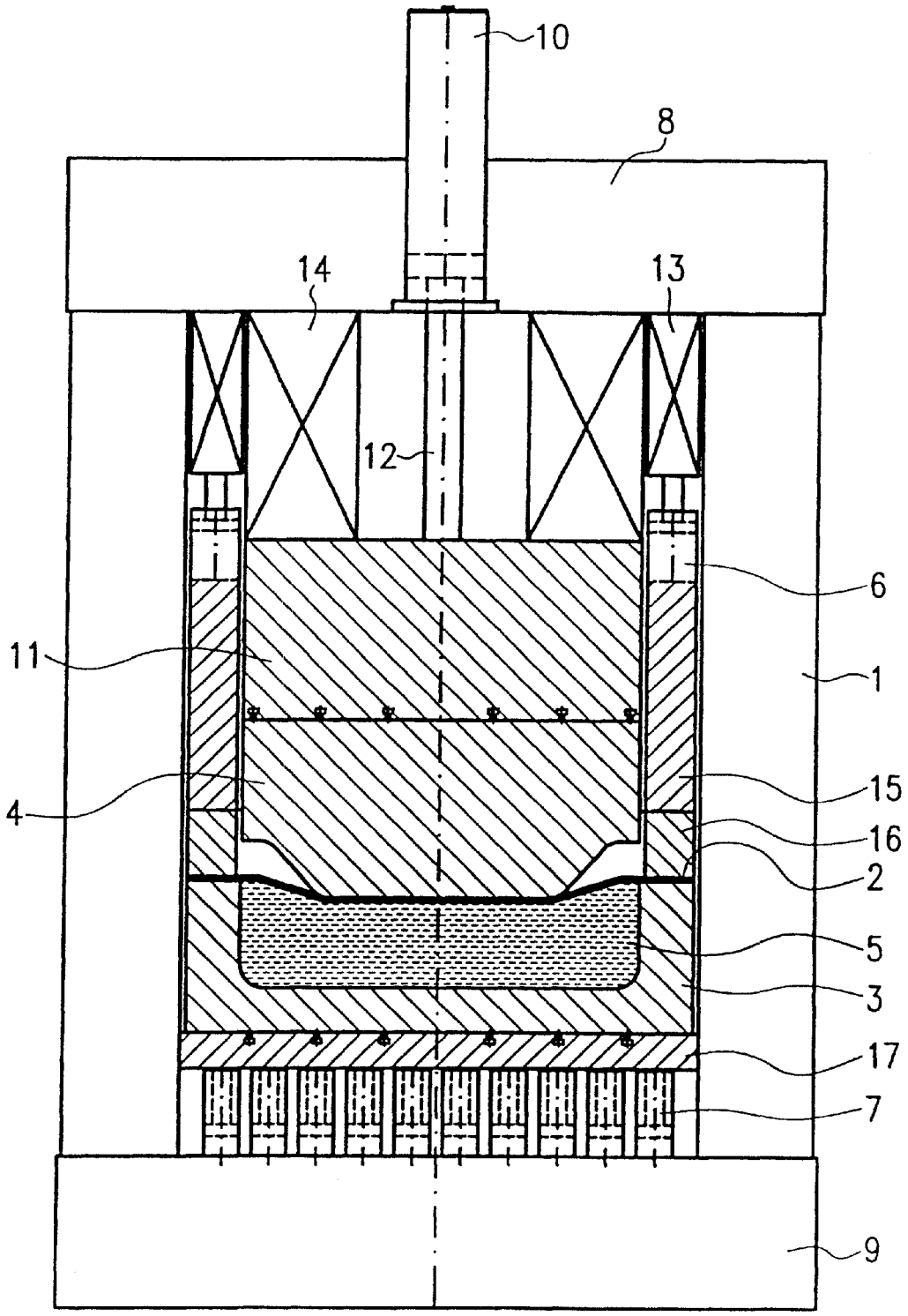
FIG. 3 is a view of the metal forming press, analogous to FIGS. 1 and 2, showing a state in which the ram tool is introduced.

FIG. 3 shows a process in which the plate of workpiece 2 is formed by the ram force $F_{St}$. In the illustrated state the ram locks 14 are already retracted after the ram 11 together with the ram tool 4 has passed through the lower dead center. As is also shown, the hold-down locks 13 are also retracted and form a counter-bearing for the application of a suitable hold-down pressure by means of the hold-down cylinders 6.

Figure 4:
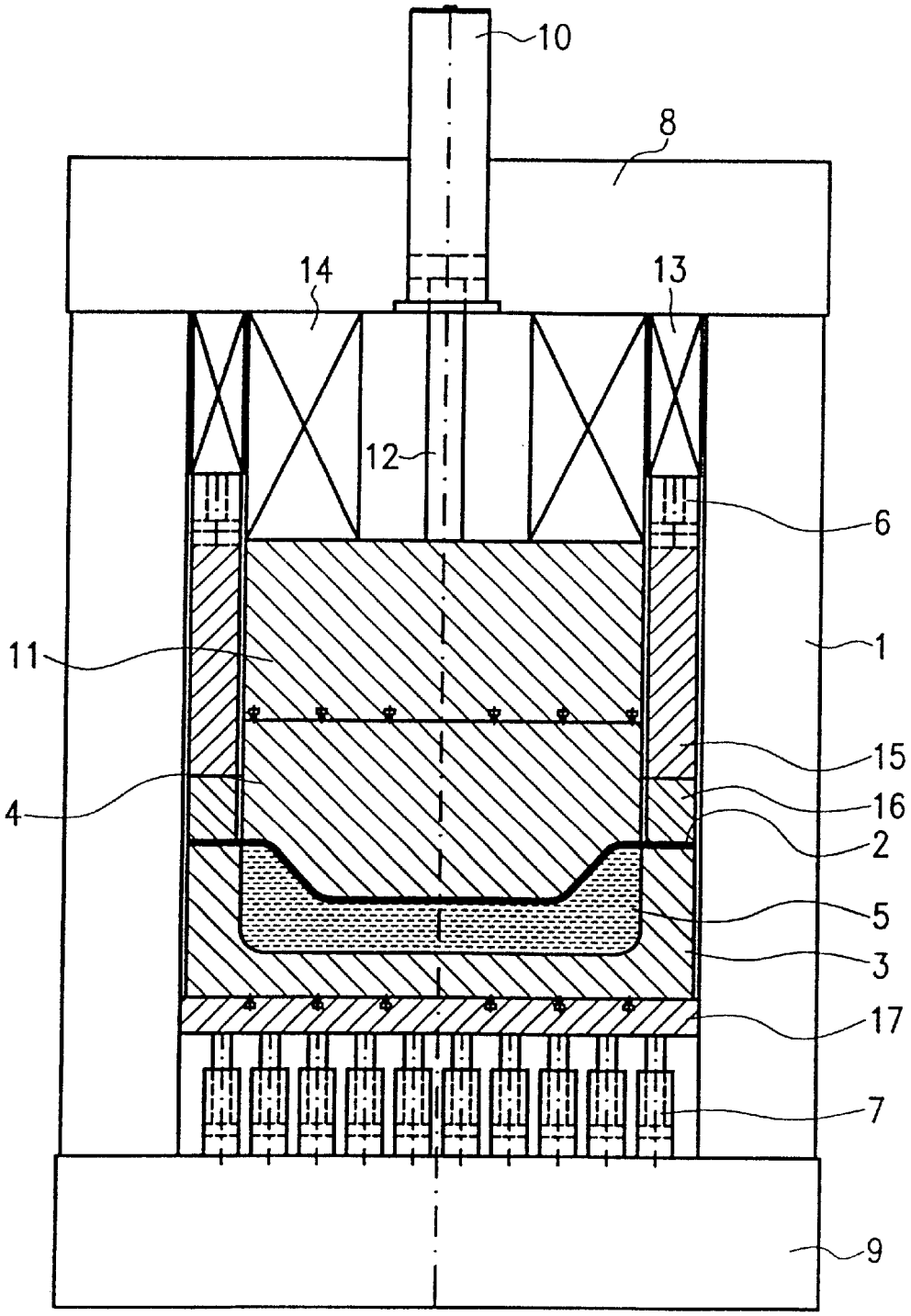
FIG. 4 is a view, analogous to FIGS. 1 to 3, showing a state in which the workpiece is given its final shape.

FIG. 4 illustrates a state of the process in which the workpiece 2 is given its final shape. While in the state shown in FIG. 3 the closing cylinders are still shown without a further function, they are extended in the state shown in FIG. 4 (FIG. 4 schematically shows the piston rods and the cylinders of the individual closing cylinders 7). Both the ram 11 with the ram tool 4 and the hold-down cylinders 6 with the hold-down ring 15 and the hold-down tools 16 are locked by the hold-down locks 13 and the ram locks 14, respectively, resulting in a firm abutment within the press frame 1 against the force of the closing cylinders 7. Thus the workpiece 2 can be finished by pressure application of the water chamber die. In this state the workpiece 2 is thus calibrated.

Figure 5:
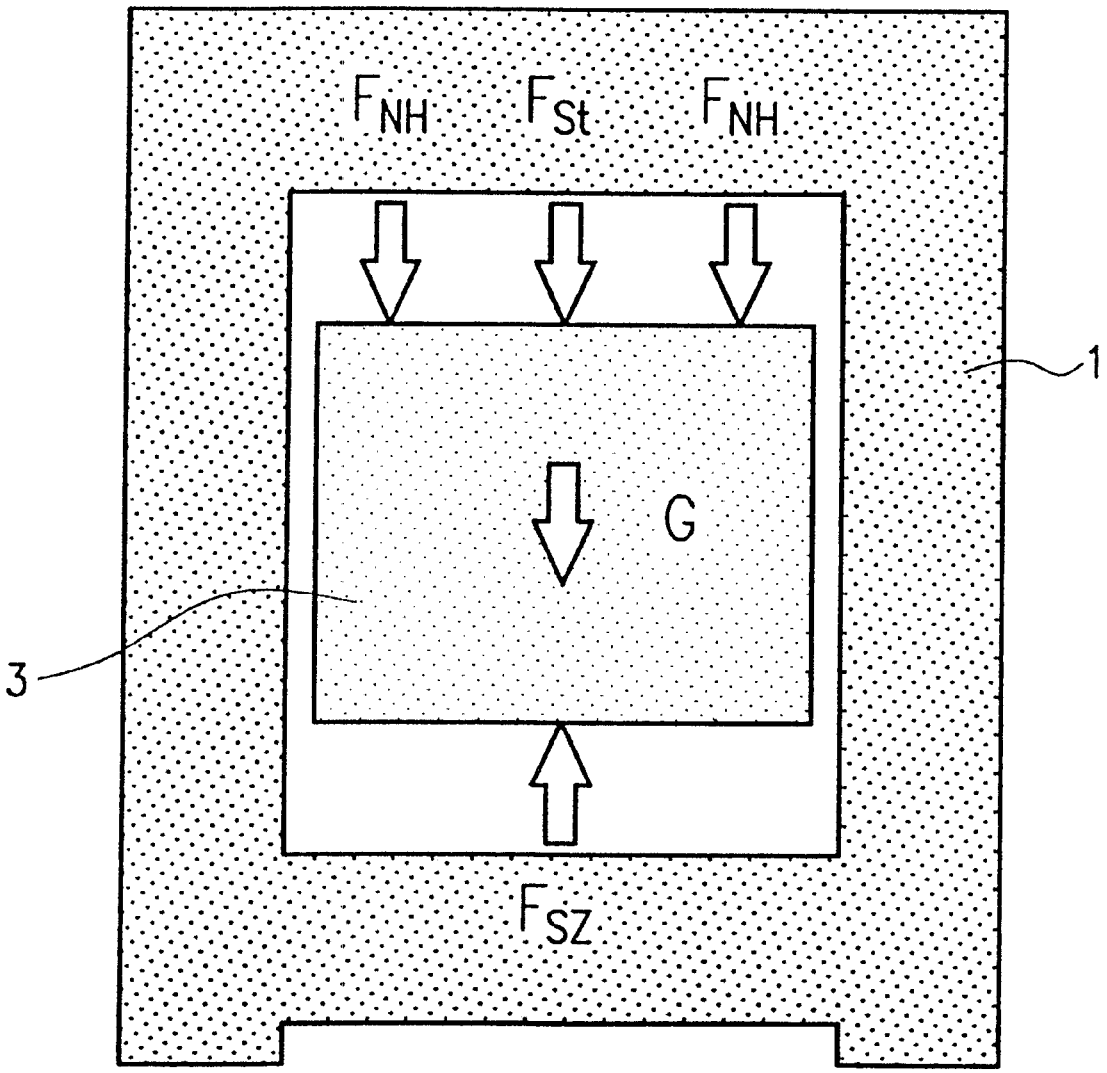
FIG. 5 is a schematic side view of the metal forming press with illustration of the arising forces.

FIG. 5 shows the force equilibrium prevailing on the press frame 1; tool 3 is only shown schematically. As becomes apparent from the illustration of FIG. 5, a cylinder closing force $F_{Sz}$ acts upwards while a weight G of the tool 3 acts downwards. Weight G includes the weight of the water in the water chamber die 5 and of other associated components and of workpiece 2. FIG. 5 further illustrates the ram force $F_{St}$, as well as the hold-down forces $F_{NH}$. It becomes apparent from this illustration which forces are operative and which force equilibrium is prevailing. Thus the closing cylinder force must compensate for both the weight G and the ram force $F_{St}$ as well as the hold-down forces $F_{NH}$. Hence, a change in one of said forces will result in a change in the closing cylinder force $F_{SZ}$.

Figure 6:
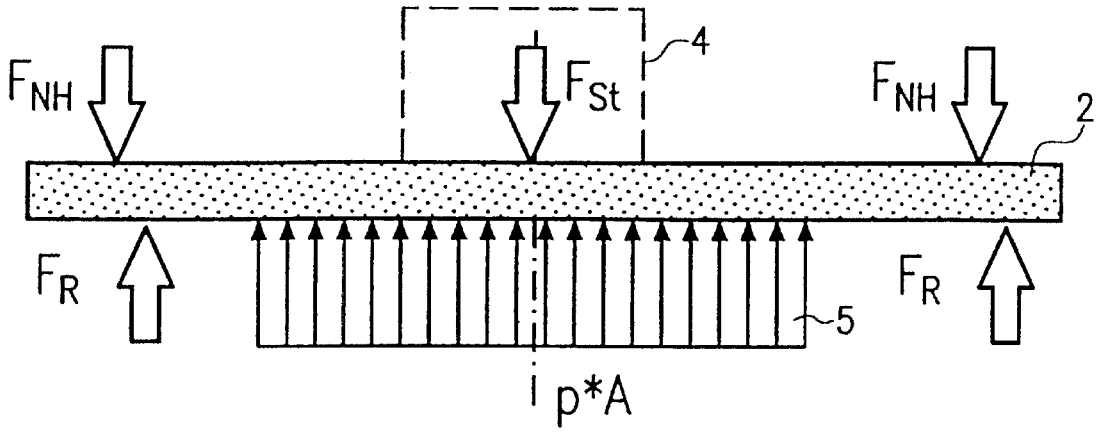
FIG. 6 is a schematic detail view of the forces acting on the workpiece.

FIG. 6 schematically illustrates the force equilibrium on workpiece 2 (sheet metal plate). A water chamber die force is operative from below and follows from the product of pressure and area (p*A). The ram force $F_{St}$ and the hold-down force $F_{NH}$ are operative from above. This yields a resulting force $F_R$ which is to be applied. Hence, it follows that $$F_R=F_{NH}+F_{St}-p*A$$

A look at the force between workpiece 2 and the resulting force $F_R$ and between the workpiece and the hold-down force $F_{NH}$ will reveal that the force between the workpiece and the hold-down device is greater than the effective ram force and the force of the water chamber die. Thus, during pre-arching of the workpiece the hold-down force decreases by the force resulting from the force of the water chamber die, while during metal forming the hold-down force decreases by the ram force.

Figure 7:
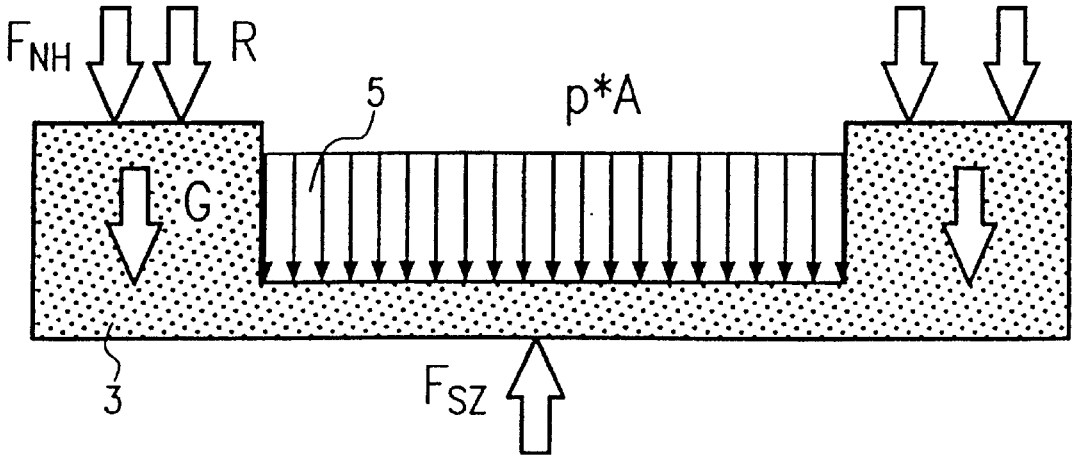
FIG. 7 is a schematic view of the forces acting on the tool.

FIG. 7 shows the force equilibrium on tool 3. The hold-down force $F_{NH}$ and the weight G act on said tool. Furthermore, there is shown a reaction force R which is introduced by the workpiece. Furthermore, the water chamber die force p*A is operative; the closing cylinder force $F_{SZ}$ acts as a counter-force.

Figure 8:
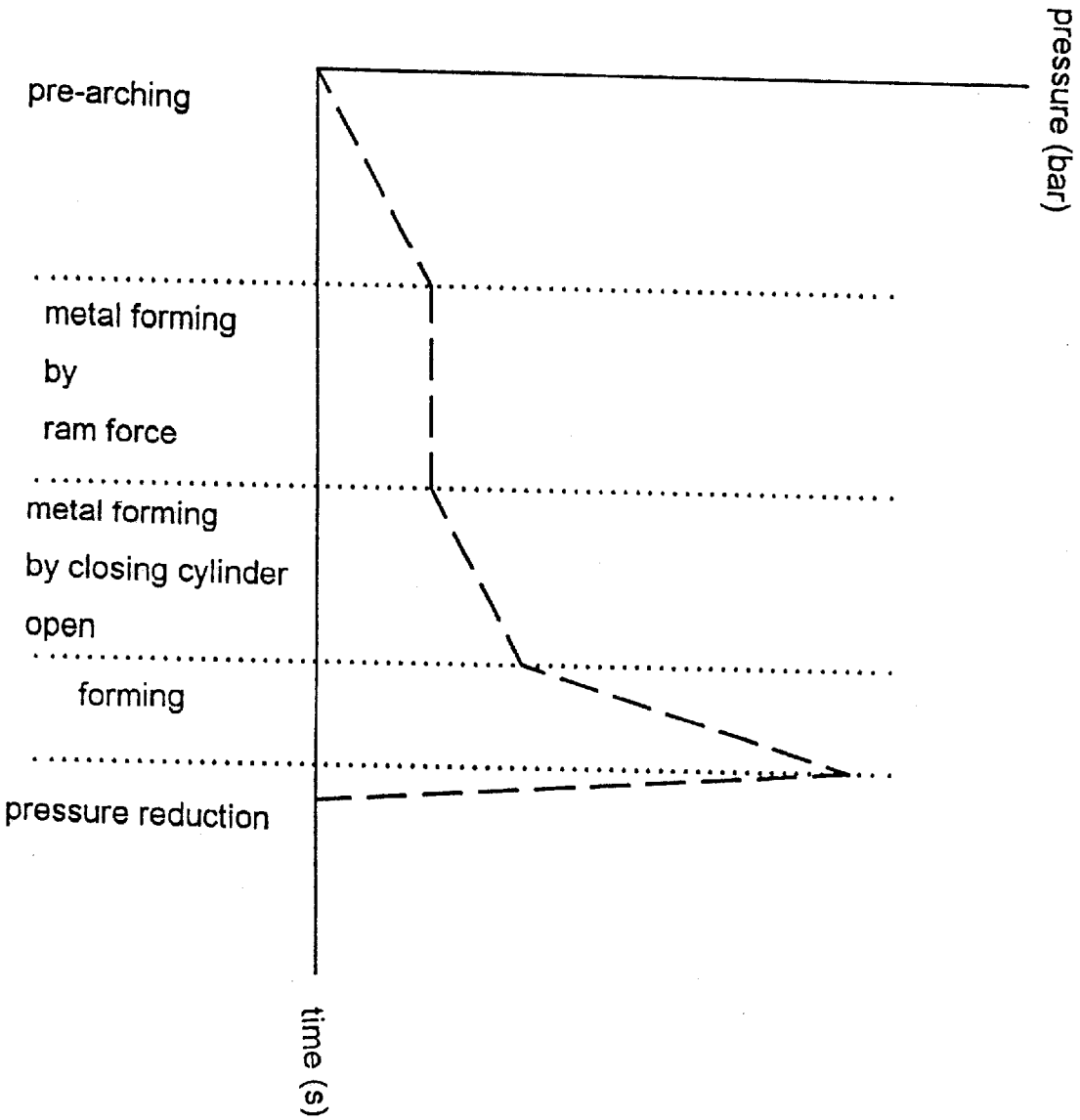
FIG. 8 shows an example of a pressure curve in the water chamber die over time.

FIG. 8 shows an example of a typical pressure curve in the water chamber die over time. In the first stage there is the already described pre-arching of the workpiece; in the subsequent stages a metal forming process is carried out by way of the ram force, as well as a further metal-forming operation, in particular also due to the pressure actuation of the closing cylinders, while in the subsequent stage calibration (forming) is carried out by analogy with FIG. 4. In the last stage the pressure reduction is shown.

Figure 9:
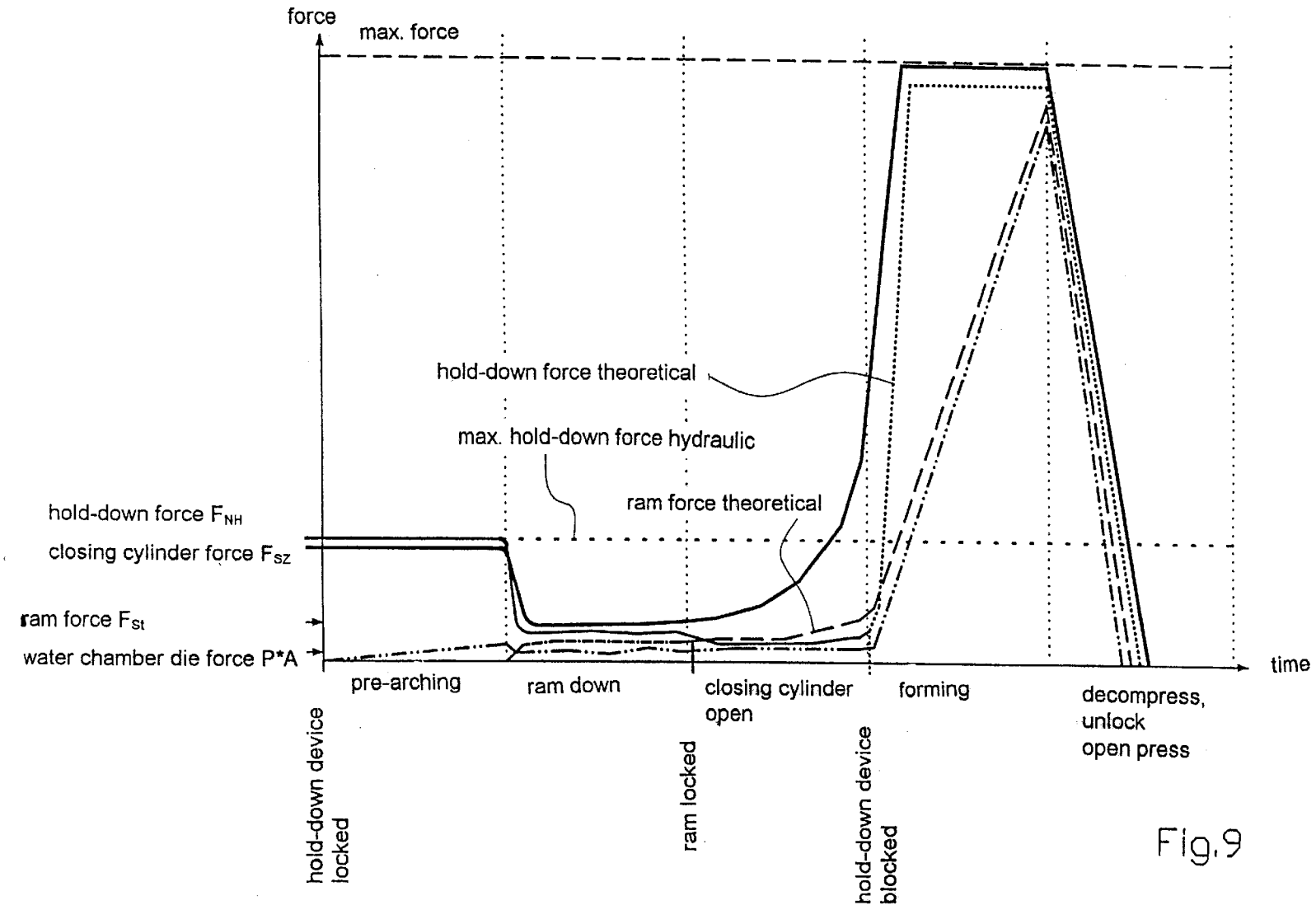
FIG. 9 shows an example of the curve of the individual forces over time.

FIG. 9 shows a further example of force curves over time. Shown are the individual steps of the method that are taken after the hold-down device has been locked, namely first of all pre-arching. As can be seen, both the hold-down force $F_{NH}$ and the closing cylinder force $F_{SZ}$ remain constant while the water chamber die force p*A is increasing. In the next forming step the ram is lowered, whereby the ram force $F_{St}$ rises, whereas both the hold-down force $F_{NH}$ and the closing cylinder force $F_{SZ}$ decrease. The closing cylinder force $F_{SZ}$ decreases to a higher degree than the hold-down force $F_{NH}$. The broken line shows the maximum hydraulic hold-down force at a constant value.

After this forming step the ram is locked, while the closing cylinders are opened. As a result, the closing cylinder force rises whereas the hold-down force decreases once again. The force prevailing in the water chamber die remains substantially constant. The hold-down device is subsequently locked or blocked. While the workpiece is calibrated or formed or shaped, the closing cylinder force rises to a maximum value while the water chamber die force also increases in linear fashion at the same time. The theoretical hold-down force and the theoretical ram force are drawn in broken line. In the last metal-forming phase there is a decompression, whereby all forces decrease.

Figure 10:
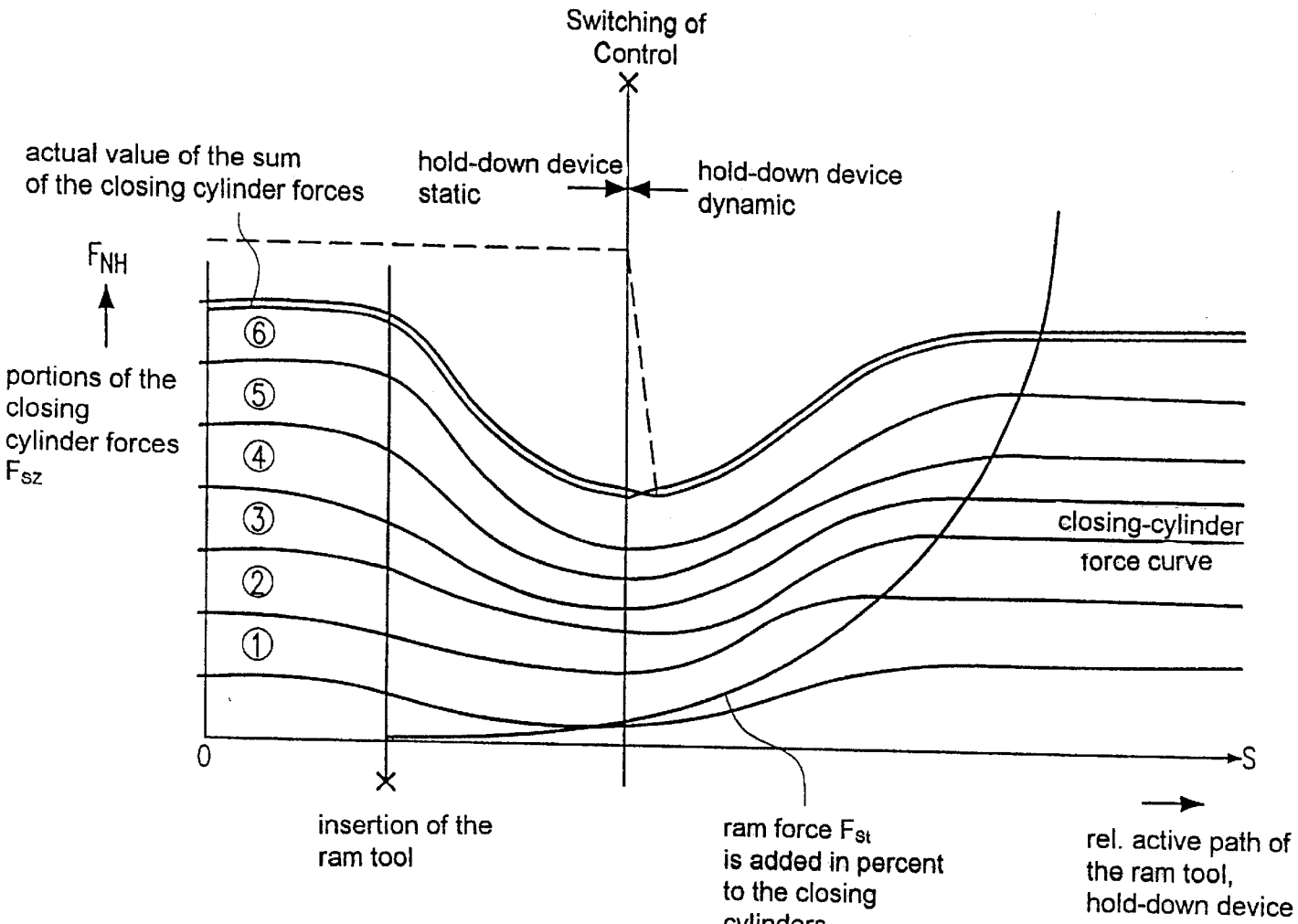
FIG. 10 shows an example of different hold-down forces over time.

FIG. 10 shows portions of different closing cylinder forces which are numbered with 1 to 6. Furthermore, the actual value of the sum of the closing cylinder forces is shown (second line from above in the left half of FIG. 10); the broken line shows the hold-down force. The curve which is parallel to the curve of the sum of the closing cylinder forces (uppermost curve in the left half of FIG. 10) is the desired curve of the sum of the closing cylinder forces. As can be seen, the summation curve of the actual values of the closing cylinder forces is above the summation curve of the desired values of the closing cylinder forces in the right half of FIG. 10. This slight increase of the force is needed for effecting a movement of the tools and for starting the forming process. The insertion of the ram tool into the workpiece according to FIG. 3 is first illustrated. Starting from this period the ram force $F_{St}$ increases; at the same time, see the diagram, the closing cylinder forces $F_{SZ}$ are each increased proportionally in percent. The control unit is then switched from a static actuation of the hold-down device to a dynamic control. The sum of the closing cylinder forces is higher than the hold-down force $F_{NH}$ while the ram force $F_{St}$ increases exponentially. The increase in the ram force $F_{St}$ automatically follows from the forming process. In the way described, the ram force is opposite to the hold-down force. The closing cylinder forces are then mainly constant over the further relative path of the ram tool and the hold-down device.

Figure 11:
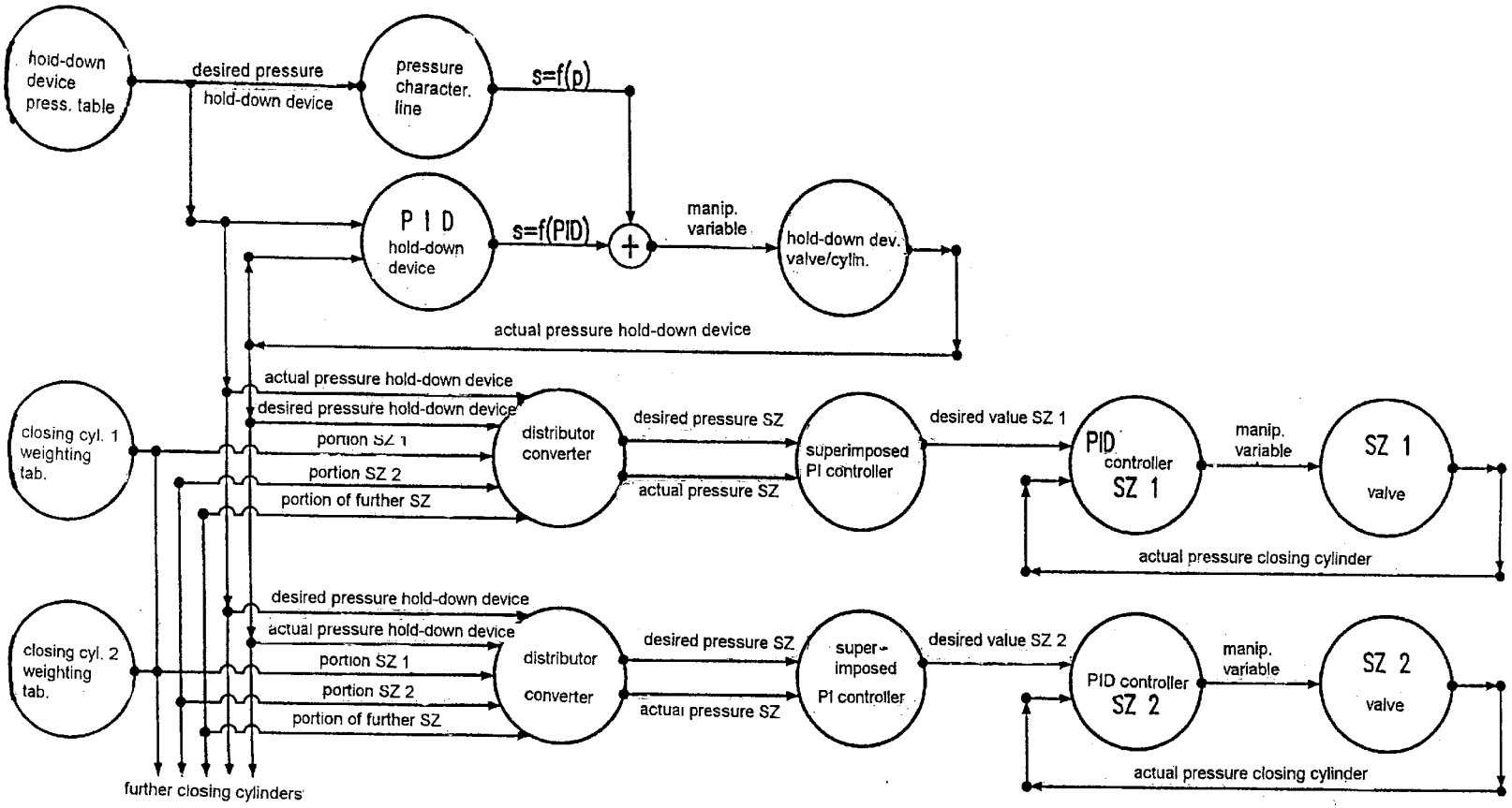
FIG. 11 is a block diagram showing an embodiment of a controller according to the invention.

FIG. 11 is a block diagram showing an embodiment of the controller of the invention. The formula of calculation according to the invention is here used as a basis for the closing cylinder forces: The sum of the closing cylinder forces is as great as the ram force plus the hold-down force plus the weight loads of table, tool, hold-down device, ram and attachments plus the frictional forces in the guides and cylinders. Thus the sum of the closing cylinder forces is equal to the product of pressure area and active area per cylinder, multiplied by the number of the connected closing cylinders. If several closing cylinder circuits are present, the total sum follows from the respective summation of the individual circuits. The total sum of the forces of the hold-down cylinders follows from the product of pressure, multiplied by effective area per cylinder, multiplied by the number of connected hold-down cylinders. If there are several hold-down cylinder circuits, the total force follows from the summation of the individual circuits. The abbreviation for closing cylinder is "SZ".

The offset is as follows:

a) Sum of the weight to be lifted (substantially constant because the weight follows from the weights of table, tool, ram and hold-down device);

b) thus of the frictional forces to be overcome by the closing cylinders, above all in the ram guides and the hold-down guides and in the cylinders;

c) actual ram force (variable).

As shown in FIG. 11, the control operation is thus carried out in the following way: The controller senses the actual pressure value of the individual hold-down devices or hold-down circuits and compares this value with the respective desired pressure the controller reads from a table, a graphic chart or a similar storage medium. The deviation is calculated on the basis of the comparative value; the deviation value is supplied to a superimposed controller (PI controller); the latter divides the deviation into the number of the active closing cylinder control circuits, namely in the ratio of the percentage weighting of said closing cylinder control circuits, which weighting has been predetermined by an operator. This value is respectively multiplied by the predetermined control parameters (PID) and output as a new predetermined value to the actuators (servo valves) of the individual closing cylinder circuits. The pressure is corrected at cycle rates of e.g. one msec until the desired value is reached. For instance, when it is found out that the desired pressure is not reached by one ton (in comparison with the respective actual values of the individual hold-down devices), said ton is divided—for instance in the case of three closing cylinder control circuits that are e.g. weighted at 50%, 30% and 20%—into pressure values of 50%, 30% and 20%. The pressure prevailing in the respective closing cylinder circuit is respectively changed by said percentages.

The invention is not limited to the illustrated embodiments; rather many alterations and modifications are possible within the scope of the present invention.

In summary, the following should be noted:

The present invention relates to a method of operating a metal forming press in which in a rigid press frame 1 a workpiece 2 is preloaded against a tool 3 by means of a hold-down force $F_{NH}$, with at least one ram tool 4 applying a ram force $F_{St}$ in parallel with the hold-down force $F_{NH}$, and closing cylinder forces $F_{SZ}$ being applied opposite to the ram force $F_{St}$ and the hold-down force $F_{NH}$, and a water chamber die being formed in the tool 3, whereby water chamber forces p*A can act on the workpiece 3, characterized in that the disturbing force resulting from the application of the ram force $F_{St}$ is determined and compensated by a change in the closing cylinder forces $F_{SZ}$.

What is claimed is:

1. A method of operating a metal forming press to perform a metal forming process comprising:

placing a workpiece to be deformed in a rigid press frame having a support tool with a water chamber die, at least one ram tool, a hold down device, and a plurality of closing cylinders;

applying a hold-down force generated by the hold-down device to the workpiece to preload the workpiece against the support tool;

applying a ram force generated by the at least one ram tool to the workpiece in a first direction parallel to the hold down force;

applying closing cylinder forces generated by the closing cylinders to the support tool in a second direction opposite to the hold down force and the closing cylinder forces;

applying water chamber die forces generated by the water chamber die on the workpiece;

determining a disturbing force resulting from the applying of the ram force to the workpiece; and compensating for the disturbing force by changing the closing cylinder forces applied to the support tool.

2. The method according to claim 1, further comprising measuring the disturbing force by way of a change in the hold-down force.

3. The method according to claim 2, wherein the determining of the change in the hold-down force is determined by a change in pressure in the hold-down device.

4. The method according to claim 1, wherein the compensating of the disturbing force is compensated by selectively operating the closing cylinders individually to generate the closing cylinder forces.

5. The method according to claim 4, further comprising the changing of the closing cylinder forces is changed by differently adjusting the closing cylinders.

6. The method according to claim 5, further comprising maintaining a sum of the closing cylinder forces constant for a respective phase of the metal forming process.

7. The method according to claim 6, further comprising individually apportioning the sum of the closing cylinder forces between each of the closing cylinders in percentage for the respective phase of the metal forming process.

8. The method according to claim 7, further comprising adjusting the closing cylinder forces of selected ones of the closing cylinders upon determining a change in a local closing cylinder force of at least one of the closing cylinders to maintain the percentage of the closing cylinder forces among the closing cylinders.

9. The method according to claim 1, further comprising determining the hold-down force which is respectively optimum in time and location then maintaining the hold-down force by changing the closing cylinder forces.

10. The method according to claim 1, further comprising dividing the hold-down force-into individual zone-like portions of the workpiece, determining a necessary partial hold-down force for each of the individual zone-like portions of the workpiece, and adjusting the closing cylinder forces to compensate for the necessary partial hold-down force for the individual zone-like portions.

11. The method according to claim 1, further comprising varying the hold-down force during the metal forming process by dividing the metal forming process into individual phases and determining the hold-down force both locally and in time according to values for the phases by a finite-element method.

12. The method according to claim 11, wherein the dividing of the individual phases forms time intervals of the metal forming process.

13. The method according to claim 11 wherein the dividing of the individual phases forms path sections of the ram tool.

14. The method according to claim 11, wherein the applying of the closing cylinder forces by the closing cylinders is adjusted such that the closing cylinder forces of the closing cylinders are assigned to the hold-down forces locally and in time for the individual phases.

15. The method according to claim 1, further comprising setting the closing cylinder forces to be greater than a mathematically predetermined local and temporal closing cylinder force for the closing cylinders to compensate for possible errors and workpiece tolerances.

16. The method according to claim 11, further comprising determining a resulting total force for the individual phases with respect to magnitude and three-dimensional position, and assigning the closing cylinders locally in response to a respective position of the resulting total force.

17. The method according to claim 1, further comprising using a controller to determine and for setting a desired pressure of the hold-down device by comparing the desired pressure with an actual value, calculating a deviation, supplying the deviation to a superimposed controller that distributes the deviation over active closing cylinder control circuits in a ratio of predetermined percentage weighting of the active closing cylinder control circuits to determine a distributed value for each of the active closing cylinder control circuits, and multiplying the distributed values by predetermined control parameters to produce a new predetermined value for each of the active closing cylinder control circuits that is output to actuators of the active closing-cylinder circuits.

18. The method according to claim 17, wherein the setting of the desired pressure is corrected at short cycle rates until desired values are reached.

* * * * *